US008091561B2

(12) United States Patent
Gueret

(10) Patent No.: US 8,091,561 B2
(45) Date of Patent: Jan. 10, 2012

(54) MASCARA BRUSH

(75) Inventor: Jean-Louis Gueret, Paris (FR)

(73) Assignee: L'Oreal S.A., Paris (FR)

( * ) Notice: Subject to any disclaimer, the term of this patent is extended or adjusted under 35 U.S.C. 154(b) by 742 days.

(21) Appl. No.: 11/723,719

(22) Filed: Mar. 21, 2007

(65) Prior Publication Data

US 2007/0221241 A1 Sep. 27, 2007

Related U.S. Application Data

(60) Provisional application No. 60/789,605, filed on Apr. 6, 2006.

(30) Foreign Application Priority Data

Mar. 22, 2006 (FR) ..... 06 50994

(51) Int. Cl.
*A45D 40/26* (2006.01)

(52) U.S. Cl. ..... 132/218

(58) Field of Classification Search ..... 132/218, 132/318, 320; 401/121, 129; 15/207.2, 236.08
See application file for complete search history.

(56) References Cited

U.S. PATENT DOCUMENTS

| | | | | |
|---|---|---|---|---|
| 5,860,432 | A | 1/1999 | Gueret | |
| 5,894,847 | A | 4/1999 | Gueret | |
| 6,390,708 | B1 | 5/2002 | Gueret | |
| 6,494,215 | B2 | 12/2002 | Gueret | |
| 6,662,810 | B2 | 12/2003 | Gueret | |
| 2002/0020426 | A1 * | 2/2002 | Gueret | 132/218 |
| 2002/0124860 | A1 | 9/2002 | Gueret | |
| 2004/0134507 | A1 * | 7/2004 | Gueret | 132/218 |
| 2004/0168698 | A1 | 9/2004 | Gueret | |
| 2004/0240926 | A1 | 12/2004 | Gueret | |
| 2005/0066990 | A1 | 3/2005 | Rousselet | |
| 2005/0236008 | A9 * | 10/2005 | Gueret | 132/218 |
| 2006/0093425 | A1 | 5/2006 | Gueret | |

FOREIGN PATENT DOCUMENTS

| | | | |
|---|---|---|---|
| CN | 1179930 | A | 4/1998 |
| CN | 1502280 | A | 6/2004 |
| CN | 1518924 | A | 8/2004 |
| EP | 0611170 | A1 | 8/1994 |
| EP | 1 236 420 | A1 | 9/2002 |
| EP | 1 236 421 | A1 | 9/2002 |
| EP | 1 424 024 | A1 | 6/2004 |
| EP | 1 444 918 | A1 | 8/2004 |
| EP | 1 510 149 | A1 | 3/2005 |
| EP | 1 649 777 | A2 | 4/2006 |
| FR | 2 749 489 | | 12/1997 |
| FR | 2 749 490 | | 12/1997 |
| FR | 2 798 267 | | 3/2001 |
| FR | 2 811 525 | | 1/2002 |

* cited by examiner

*Primary Examiner* — Todd Manahan
*Assistant Examiner* — Brianne O'Neill
(74) *Attorney, Agent, or Firm* — Finnegan, Henderson, Farabow, Garrett & Dunner LLP

(57) ABSTRACT

The present invention relates to an applicator for applying a composition to the eyelashes or the eyebrows, the applicator comprising: a stem extending along a longitudinal axis; and a brush fastened to the stem, the brush comprising: a core having a substantially rectilinear portion that slopes relative to the longitudinal axis of the stem; and bristles extending from the substantially rectilinear portion of the core, the bristles having free ends that define an envelope surface that presents at least one face having a generator line that is substantially parallel to the longitudinal axis of the stem.

34 Claims, 4 Drawing Sheets

MASCARA BRUSH

This non provisional application claims the benefit of French Application No. Mar. 22, 2006 filed on 06 50994 and U.S. Provisional Application No. 60/789,605 filed on Apr. 6, 2006.

The present invention relates to applicators for applying a composition to the eyelashes or the eyebrows.

The invention relates more particularly to an applicator comprising a stem that extends along a longitudinal axis, and a brush that is fastened to the stem, the brush comprising a core and bristles that extend from the core.

BACKGROUND OF THE INVENTION

French patent applications FR-A-2 749 489 and FR-A-2 749 490 disclose brushes that have a non-rectilinear core, e.g. that is shaped to match the curve of the eye. Such brushes are not suitable for all users, since the curve of the brush requires the user to perform strokes that certain people find difficult.

Patent application EP-A2-1 236 420 discloses a brush having a core that is curved over at least a fraction of its length, the free end of the brush not being in alignment with the axis of the stem. During manufacture of the device comprising the receptacle and the brush, such a brush can turn out to be relatively difficult to insert in the neck of the receptacle containing the composition.

European patent application EP-A-1 424 024 discloses an applicator comprising a brush having a core that includes a portion carrying the bristles that forms a non-zero angle of less than 20° with the longitudinal axis of the end of the stem.

Such brushes require the user to adapt the strokes they use, since said brushes do not enable the user to comb the eyelashes or the eyebrows in the same manner as with a conventional brush that has a core that does not slope relative to the longitudinal axis of the stem.

Brushes are also known that comprise a rectilinear core that extends along the axis of the stem and that has bristles that define an envelope surface that presents at least one concave or convex face.

French patent application FR-A-2 811 525 discloses "off-center" brushes having a core that extends in alignment with the stem and along the longitudinal axis of said stem, the brush presenting faces forming a non-zero angle with the longitudinal axis of the core.

The off-center brushes present the drawback of external appearance that can turn out to be disconcerting to the user. In addition, they are not wiped symmetrically from one end of the brush to the other, thereby causing flattening over continued use.

SUMMARY

There thus exists a need to improve still further brushes for applying a composition to the eyelashes or the eyebrows, and to benefit from an applicator that enables application to be satisfactory and that is easy to use.

The invention seeks to satisfy that need.

The invention thus provides an applicator for applying a composition to the eyelashes or the eyebrows, the applicator comprising:

- a stem extending along a longitudinal axis; and
- a brush fastened to the stem, the brush comprising:
  - a core having a substantially rectilinear portion that slopes relative to the longitudinal axis of the stem; and
  - bristles extending from the substantially rectilinear portion of the core, the bristles having free ends that define an envelope surface that presents at least one face having a generator line that is substantially parallel to the longitudinal axis of the stem.

The above-mentioned face is created by moving the generator line parallel to itself.

The face may optionally be defined laterally by ridges.

By means of the presence of such a face, the brush turns out to be less disconcerting to the user in spite of the slope given to the core, and encourages the user to apply makeup as with a conventional brush of cylindrical envelope surface having a generator line that is parallel to the longitudinal axis of the stem.

The brush enables application to be continuous and uniform, with the eyelashes being separated and curled in satisfactory manner.

The applicator of the invention turns out to be easy to use even by a person who is used to using conventional brushes.

In addition, the slope of the core and its off-center position can enable the user to benefit from certain advantages of off-center brushes, for example in terms of the bristles penetrating into the eyelashes, and in terms of combing said eyelashes.

The slope of the core can also improve the quality of brush-wiping, said wiping being relatively uniform, and can reduce the risk of the brush being flattened.

The envelope surface may present a non-circular cross-section at at least one point along its length.

At at least one point along its length, the cross-section of the envelope surface may present a general shape selected from the following list: polygonal, in particular triangular, square, pentagonal, or hexagonal; oblong, in particular oval or lens-shaped; or some other shape.

The above-mentioned face may be substantially plane.

For at least one cross-section of the envelope, the core may define a center of symmetry of said section. The core may also be off-center within the cross-section of the envelope surface at at least one point along the length of the brush.

The substantially rectilinear portion of the core of the brush may form an angle with the longitudinal axis of the stem that is less than 20°, e.g. that lies in the range 0.2° to 15°, preferably in the range 1° to 10°, better in the range 5° to 10°. In a variant, the angle may be greater than 20°.

The above-mentioned face of the brush may present a width, measured perpendicularly to the longitudinal axis of the stem, that decreases towards the free end of the brush, e.g. in linear manner. In a variant, the face of the brush may present a width, measured perpendicularly to the longitudinal axis of the stem, that is substantially constant, or that varies in non-linear manner.

The core of the brush may include an end that is fastened to the stem, e.g. that is inserted in a housing formed at a free end of the stem.

The core may present a free end, remote from the stem, that may constitute the point of the core that is the furthest away from the longitudinal axis of the stem. The free end of the core may be situated at a distance from the longitudinal axis of the stem of less than 7.5 mm, better of less than 4.5 mm.

The envelope surface may be of non-constant cross-section over the major portion of the length of the brush.

The brush may present at least one longitudinal ridge, e.g. two to eight longitudinal ridges. The ridges may be defined at the intersections of the faces of the envelope surface, and they may be rectilinear, for example.

The brush may present at least one concave face. The brush may present at least one convex face, of radius of curvature, when the brush is observed in cross-section, that is greater than the length of the longest bristle extending from the core in said cross-section.

The core may include at least two twisted metal strands. The strands may be twisted with a left-hand twist. In a variant, the strands may be twisted with a right-hand twist. The strands may have a diameter lying in the range 0.35 mm to 1 mm, for example.

The applicator may include at least two bristles of different diameters. The bristles may have a greatest transverse dimension lying in the range 65 micrometers (μm) to 400 μm, for example. The applicator may include at least one bristle made of an elastically-deformable material.

The applicator may include at least one bristle including a compound, e.g. particulate or other, making it possible to improve sliding of the bristle over keratinous fibers, or, in contrast, making it possible to create surface roughness to catch the fibers more strongly.

The applicator may include a mixture of bristles.

The applicator may include at least one bristle presenting at least one undulation, and, in particular, it may include at least two bristles, each including at least one periodic pattern presenting at least one undulation, at least two periodic patterns being different. The two different periodic patterns may belong to two distinct bristles or to the same bristle, and the undulations may present different shapes, e.g. a sawtooth shape or a sinusoidal shape, or even different amplitudes, or even undulations of different spatial frequencies. The expression "periodic pattern" means, within a bristle, a portion of said bristle that is substantially reproduced, in periodic manner, along the bristle.

The applicator may include bristles that are made other than by being injection-molded with the core, and the brush may include at least one portion having curved bristles extending in oriented manner from the core, e.g. as described in US application No. 2004/0168698, the content of which is incorporated herein by reference. The term "extending in oriented manner" means that the curved bristles extend with a general orientation that is defined during manufacture of the brush, and they do not extend with completely random orientations. In particular, the bristles may be oriented in the same circumferential direction around the core. The bristles of the brush may be curved by contact with a hot surface, in particular a surface moving relative to the brush.

The applicator may include a twisted core defining turns, the bristles being engaged between the turns of the brush. The brush may include at least two deformed bristles that are engaged between two adjacent turns, each bristle presenting a removal of material or a flattening at at least one point along its length from the core, and extending outwards, non-radially, from said point, as described in US application No. 2004/0240926, the content of which is incorporated herein by reference. Each deformed bristle may include two rectilinear portions forming a bend between them. The two rectilinear portions may present the same cross-section. All of the deformed bristles may define bends that are all situated substantially at the same distance from the core.

By way of example, the brush may include 5 to 80 bristles per turn, even 15 to 40, in particular 10 to 50 bristles per turn. The brush may also include only 5 to 20 bristles per turn. The number of bristles per turn corresponds to the number of bristle ends counted by a stationary observer while the brush turns through 180° about its core.

The applicator may include twisted bristles, e.g. as described in U.S. Pat. No. 6,390,708, the content of which is incorporated herein by reference.

The above-mentioned face may have a length, measured along the longitudinal axis of the stem, that is greater than half, indeed greater than two-thirds, of the visible length of the core outside the stem.

The stem may be connected to a handle. The handle may be arranged in such a manner as to close, in leaktight manner, a receptacle containing the composition for application.

The invention also provides a packaging and applicator device for applying a composition to the eyelashes or the eyebrows, the device comprising a receptacle containing the composition for application, and an applicator as defined above. By way of example, the composition is a cosmetic, makeup, or a care product, e.g. mascara.

The device may further comprise a wiper disposed in such a manner as to wipe the brush while it is being removed from the receptacle. The wiper may be fastened in the neck of the receptacle.

In another of its aspects, the invention also provides a method of manufacturing an applicator as defined above, the method comprising the following steps:

- machining a brush blank, having a rectilinear core and a generally circularly-cylindrical envelope surface, in such a manner as to form at least one face having a generator line that slopes relative to the longitudinal axis of the core; and
- bending the core in such a manner as to form a rectilinear portion on which the face extends, and a proximal portion that is fastened in the stem or that is for fastening therein, and to orientate the face substantially parallel to the longitudinal, axis of the proximal portion of the core.

BRIEF DESCRIPTION OF THE DRAWINGS

The invention can be better understood on reading the following detailed description of non-limiting embodiments thereof, and on examining the accompanying drawings, in which.

MORE DETAILED DESCRIPTION

Figure 1:
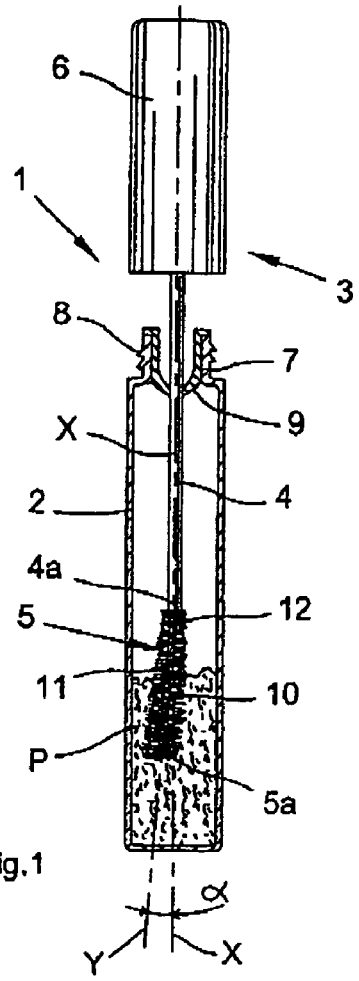
FIG. 1 is diagrammatic view in elevation, and partially in axial section, showing an embodiment of a packaging and applicator device of the invention.

FIG. 1 shows a packaging and applicator device 1 comprising: a receptacle 2 containing a composition P for application to the eyelashes or the eyebrows, e.g. mascara; and an applicator 3 comprising: a stem 4, e.g. of circular cross-section, that is provided at its distal end 4*a* with a brush 5 and that is connected at its proximal end to a handle 6 that also constitutes a closure cap for closing the receptacle 2. The receptacle is fitted with a wiper 7, e.g. constituted by a part made of elastomer that is inserted in the neck 8 of the receptacle. The wiper can optionally be conventional, indeed it can be adjustable.

In the embodiment under consideration, the stem 4 presents a rectilinear longitudinal axis X that coincides with the axis of the neck 8 of the receptacle 2 when the applicator is in place on said receptacle.

In manner known per se, when screwed tight, the handle 6 is arranged to close the receptacle 2 on the neck 8 in leaktight manner.

In the embodiment shown, the wiper 7 includes a wiper orifice 9 of circular section, having a diameter that corresponds substantially to the diameter of the stem 4.

The brush 5 includes a core 10 formed by two twisted metal strands, the core 10 having a proximal portion that is fastened in a housing of the stem 4, e.g. being force-fitted in the housing.

In the embodiment under consideration, the core 10 also includes a substantially rectilinear portion 10*a* that extends along a longitudinal axis Y that forms an angle $\alpha$ with the longitudinal axis X of the stem 4.

The rectilinear portion 10*a* is connected to the proximal portion that is engaged in the stem 4, thereby forming a bend. In the embodiment under consideration, the bend is situated in the vicinity of the distal end 4*a* of the stem, but it could also be situated at a greater distance from the stem.

Figure 3:
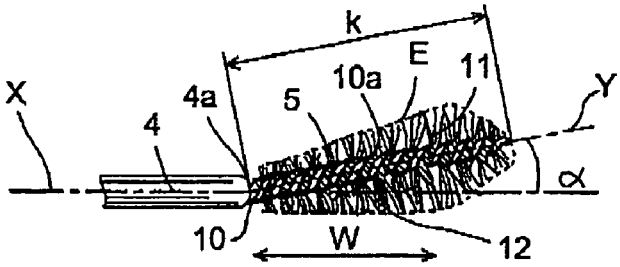
FIGS. 3 and 4 are fragmentary views showing the applicator of FIGS. 1 and 2 as seen looking along perpendicular directions III and IV respectively of FIG. 2.
Figure 4:
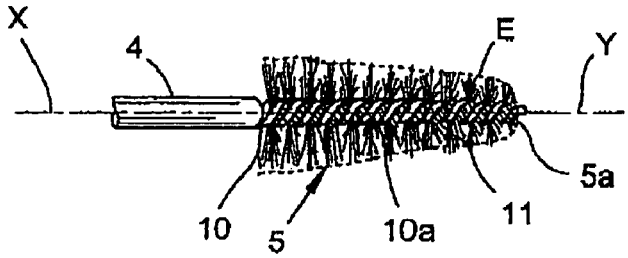

By referring to FIGS. 3 and 4, it can be seen that the substantially rectilinear portion 10*a* of the core 10 carries bristles 11 that are held by being clamped between the twisted strands of the core 10 and that extend substantially radially from the core.

Figure 2:
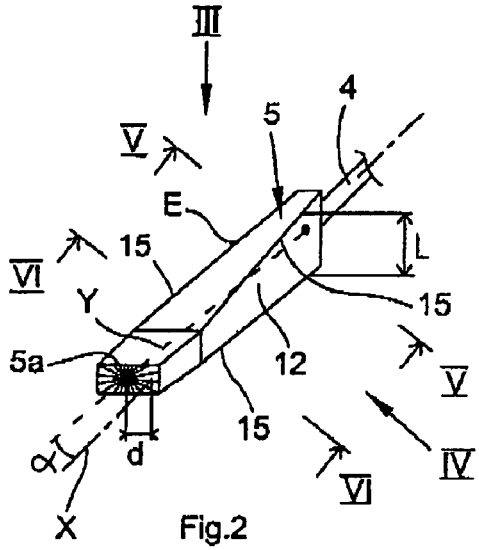
FIG. 2 is a diagrammatic and fragmentary perspective view showing the applicator of the FIG. 1 device.

FIG. 2 shows the envelope surface E defined by the free ends of the bristles 11 of the brush 5.

Given the length of the brush 5, the angle $\alpha$ can be small enough for said brush not to come into contact with the inside surface of the receptacle 2 when the applicator is in place. Naturally, it is not beyond the ambit of the present invention for the receptacle 2 to present dimensions such that the brush 5 does indeed come into contact with said surface.

The distance d between the axis X and the axis Y at the free end 5*a* of the brush is not greater than 4.5 mm, e.g. being close to 3 mm. Naturally, the distance d depends on the length of the brush and can be greater than 4.5 mm without going beyond the ambit of the present invention.

In the embodiment under consideration, the core 10 carries bristles 11 along substantially the entire length of its substantially rectilinear portion 10*a*. In a variant, said rectilinear portion may be free of bristles over a certain distance from the stem 4.

The envelope surface E defines at least one substantially plane face 12 having a generator line that extends substantially parallel to the longitudinal axis X of the stem.

The plane face 12 has a width l that, in the embodiment under consideration, decreases from the stem 4 towards the free end of the brush 5, said width being measured between the two ridges 15 laterally defining the face 12.

Figure 5:
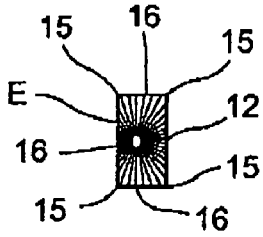
FIGS. 5 and 6 are cross-sections on V-V and VI-VI of the FIG. 2 applicator.
Figure 6:
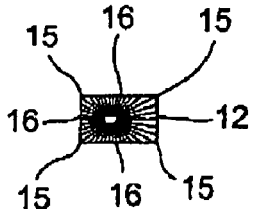

As shown in FIGS. 5 and 6, the brush 5 includes three other plane faces 16 that are not parallel to the axis X, of which the face opposite the above-mentioned face 12 has a width that decreases towards the free end of the brush, while the other two faces have widths that increase in said same direction.

The envelope surface E can present a distal portion having a truncated pyramid shape, as shown in FIG. 2. The same could apply in the proximity of the stem 4, so as to make it easier for the brush to pass through the wiper 7.

By way of example, the plane face 12 extends along the axis X over a distance w that represents more than half of the total length k of the visible portion of the core, better more than two-thirds of the length k, as shown in FIG. 3.

In order to make the brush 5, it is possible, for example, to start with a brush blank of envelope surface that is circularly cylindrical about the axis X of the stem, the longitudinal axis Y of the core being rectilinear and in alignment with the axis X.

The blank is machined in order to give it a shape, in section, that is off-center relative to the axis Y.

In particular, it is possible to cut the brush by means of a cutter head that is rotated about an axis of rotation that is perpendicular to the longitudinal axis of the stem, in such a manner as to form the plane faces 16 and 12 and the distal portion, the plane face 12 forming an angle $\alpha$ with the longitudinal axis Y of the core.

During manufacture of the brush, it is possible to machine a first side, then turn the brush, each time through one fourth of a turn, about its longitudinal axis Y, relative to the cutter head, so as to machine the next side. In a variant, it can be the cutter head that is displaced relative to the brush, or both the cutter head and the brush that are displaced.

By way of example, the cut blank can be one of the brushes described in application FR-A1-2 811 525.

By way of example, the face 16 opposite the face 12 can be machined in such a manner as to come closer to the core on going towards the stem 4.

The other two faces 16 that are opposite can be machined in such as manner as to come closer to the core on going away from the stem 4.

The blank can be cut even after the core has been fastened to the stem.

Then, where it leaves the stem 4, the core 10 is bent through an angle $\alpha$, so as to orientate the plane face 12 substantially parallel to the longitudinal axis X of the stem 4.

In a variant, the brush is machined and/or bent before being fastened to the stem.

In order to apply makeup, the user unscrews the applicator and removes the brush 5 from the receptacle 2.

When the angle $\alpha$ is small, e.g. less than 10°, the applicator 3 can be used easily, without it being necessary to begin by locating the orientation of the core 10 about the axis X during application of the composition and combing of the eyelashes.

The user can use the plane face 12 that extends parallel to the longitudinal axis X of the stem to apply the composition P to the eyelashes or eyebrows and/or to comb said eyelashes or eyebrows.

Where appropriate, the user can also turn the brush 5 about its axis X.

While applying makeup, the ridges 15 can make it easier to separate eyelashes that may possibly become stuck together as a result of too much composition in certain places.

The slope of the core can favor combing and curling of the eyelashes, by enabling the bristles of the brush to penetrate better into the set of eyelashes.

Naturally, various modifications can be applied to the applicator, and in particular to the brush, without going beyond the ambit of the present invention.

Figure 7:
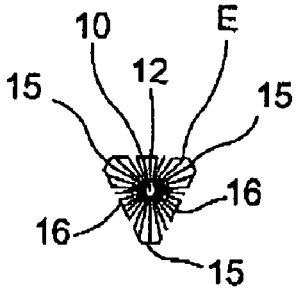
FIGS. 7 to 14 show examples of cross-sections of the envelope surface, amongst others.
Figure 15:
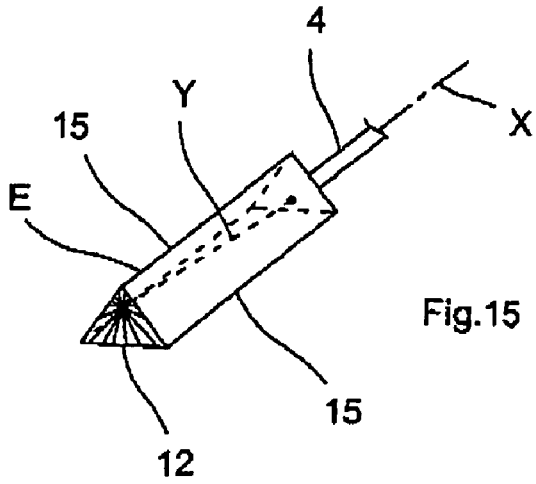
FIGS. 15 to 18 are fragmentary views of variant embodiments of the applicator.

The envelope surface E of the brush could present another shape in cross-section at at least one point along its length, e.g. a triangular shape as shown in FIGS. 7 and 15.

More particularly, in this embodiment, the brush defines three longitudinal ridges 15 and three substantially plane faces that extend between the ridges, one of which faces 12 extends substantially parallel to the longitudinal axis of the stem, and is accompanied by two other faces 16.

In the embodiment in FIG. 15, the cross-section of the envelope surface E of the brush is substantially triangular and constant over the entire length of the brush. However, within the cross-section, the core 10 occupies a position that varies along its length.

Thus, the core 10 is closer to the face 12 at its end beside the stem than at its opposite end.

Figure 16:
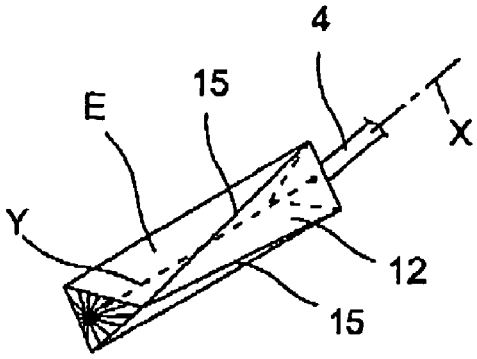

In another variant, the cross-section need not be constant, as shown in FIG. 16. In this embodiment, the cross-section of the brush is triangular at the ends and is a non-regular hexagonal between the two ends. The plane face 12 has the general shape of an isosceles triangle, being defined by ridges 15.

Figure 8:
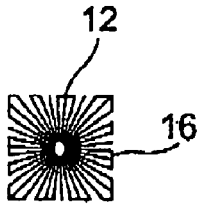
Figure 9:
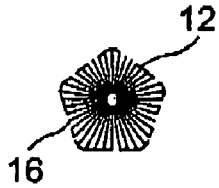
Figure 10:
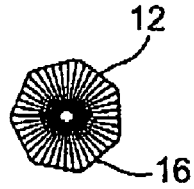
Figure 17:
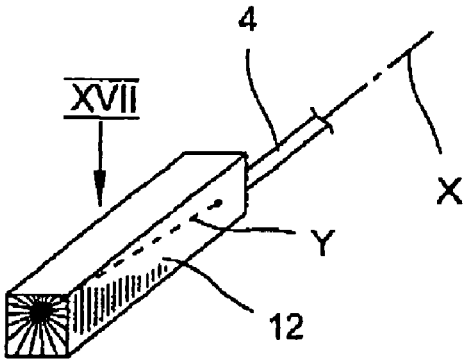

The brush can also be given various other cross-sections, e.g. square, as shown in FIG. 8, or pentagonal or hexagonal, as shown in FIGS. 9 and 10 respectively. In the variant embodiment shown in FIG. 17, the cross-section of the brush is square.

Figure 11:
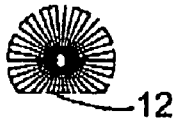

By way of example, the brush can also include an envelope surface of circular cross-section with at least one flat, as shown in FIG. 11. The flat can define the face 12 having a generator line that is parallel to the longitudinal axis X of the stem 4.

In all of the embodiments described above, the face 12 is plane, but it is not beyond the ambit of the present invention for the face 12 to be defined by a generator line that is moved parallel to the longitudinal axis X along a non-rectilinear path.

Figure 12:
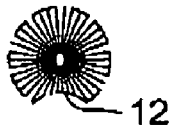
Figure 13:
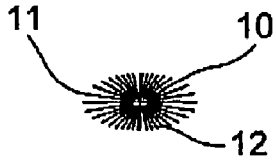

By way of example, FIG. 12 shows a brush including at least one concave face 12 having a generator line that is parallel to the axis X, and FIG. 13 shows a brush with at least one convex face 12. In FIG. 13, it can be seen that the brush can present an envelope surface of cross-section, at at least one point along the core, that is oblong, in particular lens-shaped.

Figure 14:
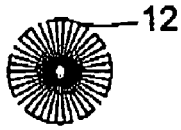
Figure 18:
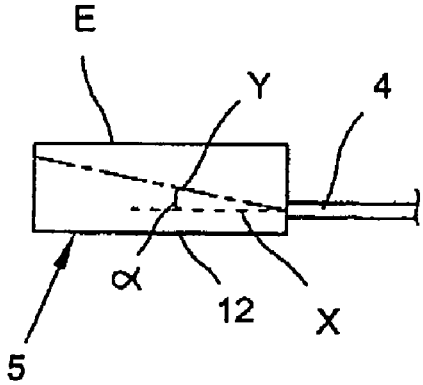

In another variant, the brush can be of circular cross-section, as shown in FIG. 14, e.g. being circularly cylindrical about the longitudinal axis X of the stem, as shown in FIG. 18, while having an envelope surface E of cross-section that is off-center relative to the longitudinal axis Y of the core. In this event, the face 12 is not defined by longitudinal ridges and extends all around the longitudinal axis Y.

In general, the brush can present an optionally-constant cross-section over the major portion of its length, or even over its entire length.

Any kind of bristles can be used in a brush made in accordance with the invention. In particular, it is possible to use a mixture of bristles of different kinds, or a mixture of bristles of different lengths, optionally of the same kind.

By way of example, the brushes shown are made with bristles of circular section, of diameter lying in the range 65 μm to 400 μm.

Figure 19:
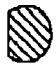
FIGS. 19 to 36 show various examples of bristle cross-sections.
Figure 20:
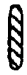
Figure 21:
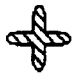
Figure 22:
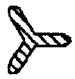
Figure 23:
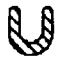
Figure 24:
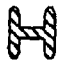
Figure 25:
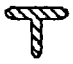
Figure 26:
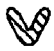
Figure 27:
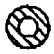
Figure 28:
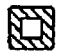
Figure 29:
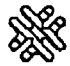
Figure 30:
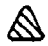
Figure 31:
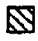
Figure 32:
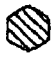
Figure 33:
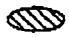
Figure 34:
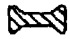
Figure 35:
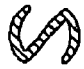
Figure 36:
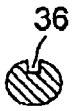

It is possible to use bristles presenting, in cross-section, one of the shapes shown diagrammatically in FIGS. 19 to 36, e.g. a circular shape with a flat as shown in FIG. 19, a flat shape as shown in FIG. 20, a star shape, e.g. a cross shape, as shown in FIG. 21 or having three branches as shown in FIG. 22, U-shaped as shown in FIG. 23, H-shaped as shown in FIG. 24, T-shaped as shown in FIG. 25, V-shaped as shown in FIG. 26, a hollow shape, e.g. circular as shown in FIG. 27 or square as shown in FIG. 28, forming ramifications, e.g. snowflake-shaped as shown in FIG. 29, of prismatic section, e.g. triangular as shown in FIG. 30, square as shown in FIG. 31, or hexagonal as shown in FIG. 32, or even oblong-shaped, in particular lens-shaped as shown in FIG. 33, or hourglass-shaped as shown in FIG. 34. It is possible to use bristles having portions that are hinged relative to one another, as shown in FIG. 35. It is also possible to use bristles that present at least one capillary channel 36, as shown in FIG. 36.

Figure 37:
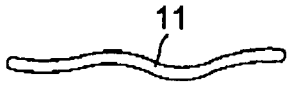
FIG. 37 shows a side view of an undulating bristle.

Before being put into place between the strands of the core, the bristles 11 that are held between the twisted strands of the core can present an optionally rectilinear shape, e.g. an undulating shape, as shown in FIG. 37.

Figure 38:
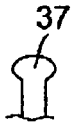
FIGS. 38 to 41 are fragmentary and diagrammatic views of examples of bristles.
Figure 39:
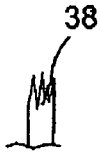

The bristles can be subjected to a treatment that seeks to form, at their ends, beads 37, as shown in FIG. 38, or spikes 38, as shown in FIG. 39.

Figure 40:
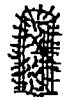
Figure 41:
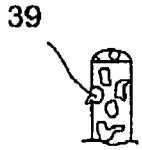

It is possible to use flocked bristles, as shown in FIG. 40, or even bristles that are made by extruding a plastics material containing a filler of particles 39, e.g. particles of a moisture-absorbing material, so as to impart a micro-relief to the surface of the bristles, as shown in FIG. 41, or so as to give them magnetic or other properties.

The bristles can also be made with a material presenting properties that favors sliding.

The bristles can be natural or synthetic, and they can, for example, be made of a material selected from: polyethylene (PE); polyamide (PA), in particular PA6, PA6/6, PA6/10, or PA6/12; HYTREL®; PEBAX®; silicone; and polyurethane (PU), this list not being limiting.

The strands of the core can be given a left-hand twist or a right-hand twist. The strands of the core can be constituted by wires of diameter lying in the range 0.35 mm to 1 mm, for example.

The brush can have a left-hand twist.

Figure 42:
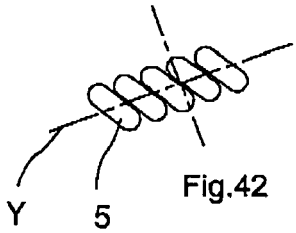
FIGS. 42 and 43 show twisted cores respectively having left-hand and right-hand twist.
Figure 43:
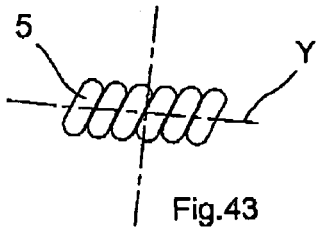

FIG. 42 shows the brush 5 with a core having a left-hand twist, and FIG. 43 shows a brush with a core having a right-hand twist. Reference could usefully be made to European patent EP 0 611 170.

Figure 44:
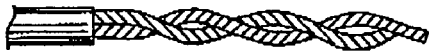
FIG. 44 diagrammatically shows a double core that is formed by twisting together two individual twisted cores.

The core can also be a double core, formed by two individual cores that are twisted together, as shown in FIG. 44. Each individual core can comprise two strands that are twisted-together, trapping bristles. Each of the two individual cores can be constituted by a branch of a single twisted core that is folded in a U-shape, the two branches being twisted together.

Naturally, the invention is not limited to the embodiments described above.

The brush could include one or more notches that could extend as far as the core of the brush.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The expression "comprising a" should be understood as being synonymous with "comprising at least one", unless specified to the contrary.

What is claimed is:

1. An applicator for applying a composition to the eyelashes or the eyebrows, the applicator comprising:

a stem extending along a longitudinal axis; and a brush fastened to the stem, the brush comprising:

a core having a substantially rectilinear portion that slopes relative to the longitudinal axis of the stem; and bristles extending from the substantially rectilinear portion of the core, the bristles having free ends that define an envelope surface that presents at least one face having a longitudinal axis that is substantially parallel to the longitudinal axis of the stem.

2. An applicator according to claim 1, in which the envelope presents a non-circular cross-section at at least one point along its length.

3. An applicator according to claim 1, in which the face is substantially plane.

4. An applicator according to claim 1, in which the envelope of the brush is of non-constant cross-section over the major portion of the length of the brush.

5. An applicator according to claim 1, in which, at at least one point, the cross-section of the envelope surface presents a general shape selected from the following list: polygonal, in particular triangular, square, pentagonal, or hexagonal; oblong, oval or lens-shaped.

6. An applicator according to claim 1, in which, for at least one cross-section of the envelope, the core defines a center of symmetry of said section.

7. An applicator according to claim 1, in which the core is off-center within a cross-section of the envelope surface at at least one point along the length of the brush.

8. An applicator according to claim 1, in which the rectilinear portion of the core of the brush forms a non-zero angle of less than 20° with the longitudinal axis of the stem.

9. An applicator according to claim 8, the angle lying in the range 0.2° to 15°.

10. An applicator according to claim 8, the angle lying in the range 1° to 10°.

11. An applicator according to claim 8, the angle lying in the range 5° to 10°.

12. An applicator according to claim 1, in which the brush presents a free end, remote from the stem, that is situated at a distance from the longitudinal axis of the stem of less than 7.5 mm.

13. An applicator according to claim 12, the distance being less than 4.5 mm.

14. An applicator according to claim 1, in which the face of the brush presents a width, measured perpendicularly to the longitudinal axis of the stem, that decreases towards the free end of the brush.

15. An applicator according to claim 14, the width decreasing in linear manner.

16. An applicator according to claim 1, in which the face of the brush presents a width, measured perpendicularly to the longitudinal axis of the stem, that is substantially constant.

17. An applicator according to claim 1, in which the core of the brush presents an end that is fastened to the stem.

18. An applicator according to claim 1, in which the core is inserted in a housing formed at a distal end of the stem.

19. An applicator according to claim 1, in which the brush presents at least one longitudinal ridge.

20. An applicator according to claim 1, in which the brush includes two to eight longitudinal ridges.

21. An applicator according to claim 1, in which the core includes at least two twisted metal strands.

22. An applicator according to claim 21, in which the strands have a diameter lying in the range 0.35 mm to 1 mm.

23. An applicator according to claim 21, in which the core defines turns, the brush including 5 to 40 bristles per turn.

24. An applicator according to claim 21, in which the strands are twisted with a left-hand twist.

25. An applicator according to claim 21, in which the strands are twisted with a right-hand twist.

26. An applicator according to claim 1, including at least two deformed bristles, each bristle presenting a removal of material or a flattening at at least one point along its length from the core, and extending outwards, non-radially, from said point.

27. An applicator according to claim 1, in which the bristles have a greatest transverse dimension lying in the range 65 μm to 400 μm.

28. An applicator according to claim 1, in which the face has a length, measured along the longitudinal axis of the stem, that is greater than half, indeed greater than two-thirds, of the visible length of the core outside the stem.

29. An applicator according to claim 1, in which the stem is connected to a handle.

30. An applicator according to claim 29, in which the handle is arranged in such a manner as to close, in leaktight manner, a receptacle containing the composition for application.

31. An applicator according to claim 1, in which the free end of the core, remote from the stem, constitutes the point of the core that is the furthest away from the axis of the stem.

32. A packaging and applicator device for applying a composition to the eyelashes or the eyebrows, the device comprising a receptacle containing the composition, and an applicator according to claim 1.

33. A device according to claim 32, further comprising a wiper disposed in such a manner as to wipe the brush while it is being removed from the receptacle.

34. A method of manufacturing an applicator as defined in claim 1, the method comprising:

machining a brush blank, having a rectilinear core and generally circularly-cylindrical envelope surface, so as to form at least one face having a generator line that slopes relative to the longitudinal axis of the core; and bending the core so as to form a rectilinear portion on which the face extends, and a proximal portion that is fastened in the stem or that is for fastening therein, and to orientate the face substantially parallel to the longitudinal axis of the proximal portion of the core.

* * * * *